United States Patent [19]

Eisenhauer et al.

[11] Patent Number: 4,932,198

[45] Date of Patent: Jun. 12, 1990

[54] CABLING MACHINE

[75] Inventors: Roland Eisenhauer; Hubert Schaub, both of Kempten; Dieter Leuthold, Wiggensbach; Erich Jenter, Kempten, all of Fed. Rep. of Germany

[73] Assignee: Saurer-Allma GmbH, Kempten, Fed. Rep. of Germany

[21] Appl. No.: 343,527

[22] Filed: Apr. 26, 1989

[30] Foreign Application Priority Data

May 25, 1988 [DE] Fed. Rep. of Germany ... 8806816[U]

[51] Int. Cl.[5] ..... D02G 3/28; D02G 3/00; D01H 7/00; D01H 13/16

[52] U.S. Cl. ..... 57/58.36; 57/58.3; 57/80; 57/352

[58] Field of Search ..... 57/58.3–58.38, 57/352, 58.83–58.86, 80–84

[56] References Cited

U.S. PATENT DOCUMENTS

| | | | |
|---|---|---|---|
| 2,870,596 | 1/1959 | Vibber | 57/58.3 X |
| 2,871,648 | 2/1959 | Vibber | 57/58.36 |
| 4,549,393 | 10/1985 | Matas Gabalda | 57/58.36 |
| 4,592,195 | 6/1986 | Charbonnier | 57/58.36 |

FOREIGN PATENT DOCUMENTS

| | | |
|---|---|---|
| 165188 | 12/1985 | European Pat. Off. . |
| 1162239 | 8/1964 | Fed. Rep. of Germany . |
| 2939435 | 4/1981 | Fed. Rep. of Germany . |
| 8401414 | 7/1984 | Fed. Rep. of Germany . |
| 1175229 | 11/1958 | France . |
| 831778 | 3/1960 | United Kingdom . |

*Primary Examiner*—John Petrakes

*Attorney, Agent, or Firm*—Flynn, Thiel, Boutell & Tanis

[57] ABSTRACT

A cabling machine comprises several cabling stations (2) each of which comprises a spindle (3), a thread combining means (7) which is disposed thereabove on a horizontal support arm (8), a delivery device (20) disposed thereabove, and above the delivery device a take-up device (22, 23). The support arm (8) can be pivoted about a vertical pivot axis (S). On the support arm (8) in extension of the spindle axis (A) are disposed a first guide roller (13), offset in a direction towards the longitudinal center plane (M) of the machine a second guide roller (14), between these two the thread monitor (15) and a thread cutter (16), and a third guide roller (18). The delivery device (20) is offset from the spindle axis (A) towards the longitudinal center plane (M) of the machine.

8 Claims, 2 Drawing Sheets

CABLING MACHINE

FIELD OF THE INVENTION

The invention concerns a cabling machine, with a machine frame and several cabling stations which are arranged therein adjacent to each other in the longitudinal direction of the machine in two rows extending symmetrically to a vertical longitudinal centre plane of the machine, and each of which comprises a cabling spindle, a thread combining means which is disposed on a horizontal support arm above the spindle in extension of the spindle axis, a delivery device disposed above the support arm, a thread monitor provided on the support arm between the thread combining means and the delivery device, and above the delivery device a take-up device with a shot thread guide reciprocatable in the longitudinal direction of the machine.

BACKGROUND OF THE INVENTION

In a known cabling machine of this kind (German patent application No. 29 39 435, FIGS. 6–9), the support arm is rigidly connected to the machine frame. In order that a feed bobbin can be inserted in the spindle, there must be sufficient vertical distance between the thread combining means, which is constructed as a guide roller, and the spindle. Due to this and the fact that the spindles are arranged a fairly large distance away from the floor, the take-up bobbin and other bobbins carried by a bobbin creel are located a relatively large distance away from the floor. Therefore they can be reached by the operator only with difficulty. For this reason, in the known cabling machine the bobbin creel is pivotable downwardly. However, this makes the cabling machine quite considerably more expensive. Operation of the cabling machine is also rendered difficult by the fact that the delivery device is disposed in the form of a leading roller relative to the vertical plane extending through the spindle axes, on the side of this vertical plane facing towards the operator. The takeup bobbins are offset from the aforementioned vertical plane towards the longitudinal centre plane of the machine. The leading rollers facing towards the operator hinder access to the take-up bobbins. Moreover, the view of the thread monitor is impaired by the leading roller and the continuous shaft carrying it, which makes threading difficult.

In another known cabling machine (European patent application No. 165 188) the delivery device, which is designed as a galette, is also disposed on the side of the vertical plane extending through the spindle axes, facing towards the operator. The twine from the delivery device is passed over a very high guide roller, in order to obtain a relatively long compensating distance between the shot thread guide and this last guide roller. The take-up device is in turn disposed, Just as in the cabling machine described first, on the side of the vertical plane extending through the spindle axes, facing towards the operator. The above disadvantages thus also apply to this cabling machine. Added to this is the fact that the last, very high guide roller makes it difficult to insert the twine. As it is located above the take-up bobbin, the twine guided over the last guide roller hinders access to the take-up bobbin.

In another known cabling machine (German Utility Model No. 84 01 414), at the free end of a rigid support arm is provided a guide roller mounted on a spring-loaded pivot arm. As a result the guide roller can move in the direction of the twine section extending between the guide roller and the take-up device. Fluctuations in tension which would be caused by the reciprocating shot thread guide are absorbed as a result. In order that new feed bobbins can be inserted in the spindles, here too a fairly large distance must be provided between the support arm and the spindles. The spindles themselves are disposed a large distance away from the floor, as supports for additional feed bobbins are provided beneath the spindles. This machine construction is suitable only for small feed bobbins, as otherwise the machine would reach a height which would exclude the possibility of easy operation.

It is the object of the invention to provide a cabling machine of the kind mentioned hereinbefore, which is suitable for large feed bobbins and nevertheless has a relatively small overall height, so that it is also easy to operate.

SUMMARY OF THE INVENTION

According to the invention, this is achieved by the fact that the spindles are arranged as low as possible in the machine frame, the support arm can be pivoted about a pivot axis arranged between the spindle axis and the vertical longitudinal centre plane of the machine and can be locked in its working position, on the support arm in extension of the spindle axis and the thread combining means are disposed a first guide roller, offset in a direction towards the longitudinal centre plane of the machine a second guide roller, between these two the thread monitor and, if occasion arises, a thread cutter, and at the free end of the support arm facing towards the outside of the machine is disposed a third guide roller, and the delivery device is disposed between a vertical plane extending through the second guide roller parallel to the longitudinal centre plane of the machine, and the longitudinal centre plane of the machine.

Due to this design, the cabling machine has a relatively small overall height, although it is designed to take large feed bobbins. As the support arm can be pivoted away about a pivot axis, it can be disposed a relatively small distance above the spindle. This and the fact that the spindles are arranged as low as possible in the machine frame, contribute substantially to a decrease in overall height. Moreover, due to the small distance between the support arm and thread combining means disposed thereon, and the spindle, the result is a thread balloon of small height and hence also lower thread tensions. The power consumption of the machine can be reduced hereby and possibly the spindle speed increased. The low overall height of the machine facilitates operation, for the heavy feed bobbins no longer have to be lifted so high. The delivery device, which is set back from the support arm and the thread monitor disposed thereon and thread cutter, in a direction towards the longitudinal centre plane of the machine, clears the view and access to the support arm and the thread guide elements provided thereon, whereby threading is greatly facilitated. Also, the setback delivery device does not in any way hinder access to the take-up bobbin.

Advantageously, the third guide roller is mounted on the support arm to allow movement against spring force in the direction of the twine section extending between the guide roller and the take-up device. This has the advantage that the length of the twine section between the third guide roller and the shot thread guide can be kept relatively short and nevertheless fluctuations in tension are absorbed by the movable spring-loaded roller. The relatively short distance between the last guide roller and the shot thread guide also contributes to the decrease in overall height.

Further advantageous developments are described below.

BRIEF DESCRIPTION OF THE DRAWINGS

The invention is explained in more detail below with reference to a practical example shown in the drawings. These show.

DETAILED DESCRIPTION

Figure 1:
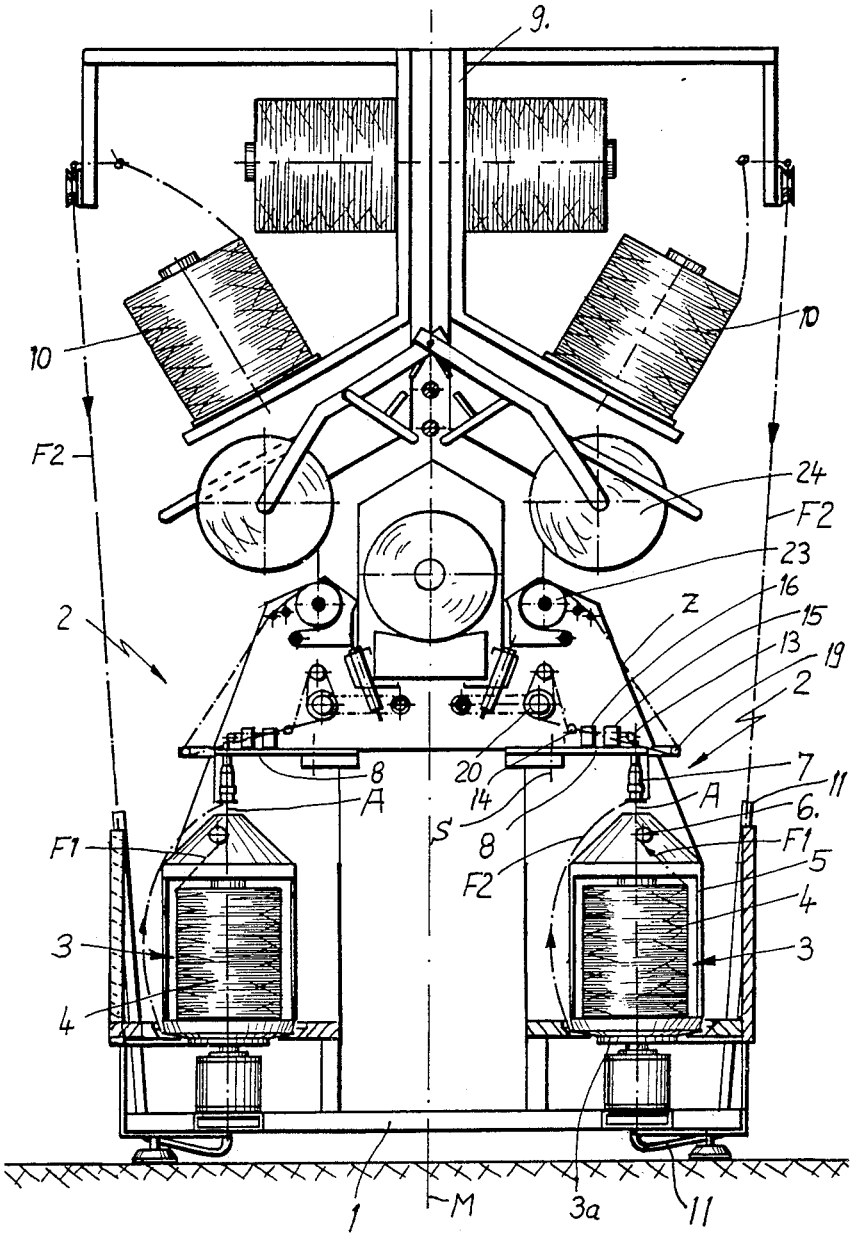
FIG. 1 a cross-section of the machine.

In a machine frame 1, on both sides of the vertical longitudinal centre plane M of the machine, several cabling stations 2 are arranged in rows adjacent to each other in the longitudinal direction of the machine. As the cabling stations 2 are of identical design, the structure of only one cabling station 2 will be described below.

The spindle 3, is arranged as low as possible in the machine frame 2. The spindle 3 carries a first feed bobbin 4 which is disposed in a stationary bobbin container 5. A first thread F1 is drawn off from this first feed bobbin 4 and guided over a thread brake 6 to a thread combining means 7. The thread combining means 7 is, for example, a twisting head mounted rotatably on the horizontal support arm 8, as described in European patent application No. 165 188 or German patent application No. 1 162 239.

A second thread F2 is drawn off from a second feed bobbin 10 disposed on the bobbin creel 9 and guided through a guide tube 11 to the lower end of the spindle 3. This thread F2 emerges radially from the spindle rotor 3*a* and rotates in the form of a thread balloon around the bobbin container 5. The thread F2 is also guided to the thread combining means 7.

Figure 2:
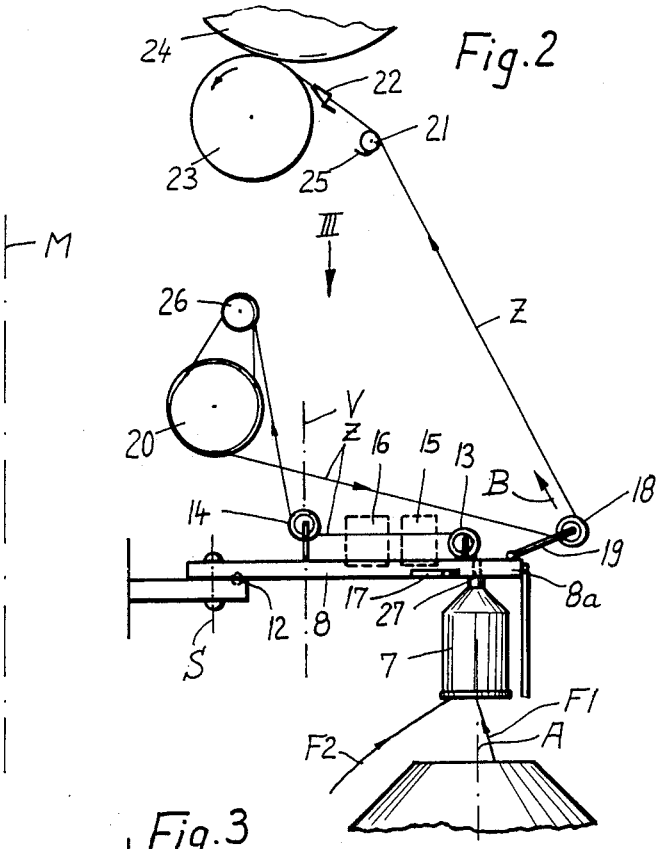
FIG. 2 details of the support arm and the thread guide in the region above the spindle in cross-section, FIG. 3 a plan view of the support arm in direction III of FIG. 2, omitting the take-up roller.

The support arm 8 is pivotable about a pivot axis S disposed between the spindle axis A and the vertical longitudinal centre plane M of the machine. This pivot axis S is appropriately arranged vertically. By means of a spring-loaded latching device 12, the support arm is fixed in its working position shown in unbroken lines in FIGS. 1, 2 and 3. A first guide roller 13 is mounted on the support arm 8 in extension of the spindle axis A. The twine passes from this roller to a second guide roller 14 which is mounted on the support arm 8 and which is offset towards the longitudinal centre plane M of the machine. The guide roller 14 should if possible be disposed in the vicinity of the pivot axis S. Between the two guide rollers 13 and 14 is disposed a thread monitor 15 and a thread cutter 16 on the support arm. Furthermore a first thread clamp 17 is located on the support arm 8. At the free end 8*a* of the support arm 8 facing towards the outside of the machine is mounted a third guide roller 18 on a pivot arm 19. The pivot arm 19 is spring-loaded, so that the third guide roller 18 is movable against spring force B.

The delivery device 20 is designed as a galette and disposed between a vertical plane V extending through the second guide roller parallel to the longitudinal centre plane M of the machine, and the longitudinal centre plane M. It is thus offset from the spindle axis A and also from the second guide roller 14, towards the longitudinal centre plane M of the machine. The twine from the delivery device 20 is guided over the third guide roller 19 and a guide rod 21 to a shot thread guide 22 which is reciprocated in the longitudinal direction of the machine. Adjacent to the shot thread guide 22 is located the driven take-up roller 23 on which the take-up bobbin 24 is supported.

The take-up roller 23 and the shot thread guide 22 together form, in a known manner, a take-up device. In the vicinity of this take-up device is provided a second thread clamp 25 on the guide rod 21.

The threads F1 and F2 from the two feed bobbins 4, 10 run into the thread combining means 7 and are there cabled into a twine, i.e. doubled with equal thread tensions. Through a bore 27 in the support arm 8, the twine Z passes over the first guide roller 13, then through the thread monitor 15 and the thread cutter 16 and the second guide roller 14. At the delivery device, which is formed by the galette 20 and a guide roller 26, the twine is looped several times around the guide roller 26 and the galette 20. From the galette 20, the twine passes over the third guide roller 18 and from there over the guide rod 21 to the shot thread guide 22 and the take-up bobbin 24. The third guide roller 18 is mounted on the support arm 8 to allow movement against spring force in the direction B of the twine section running between the guide roller 18 and the take-up device. As a result, fluctuations in tension which are caused by the reciprocating shot thread guide 22 are absorbed.

Figure 3:
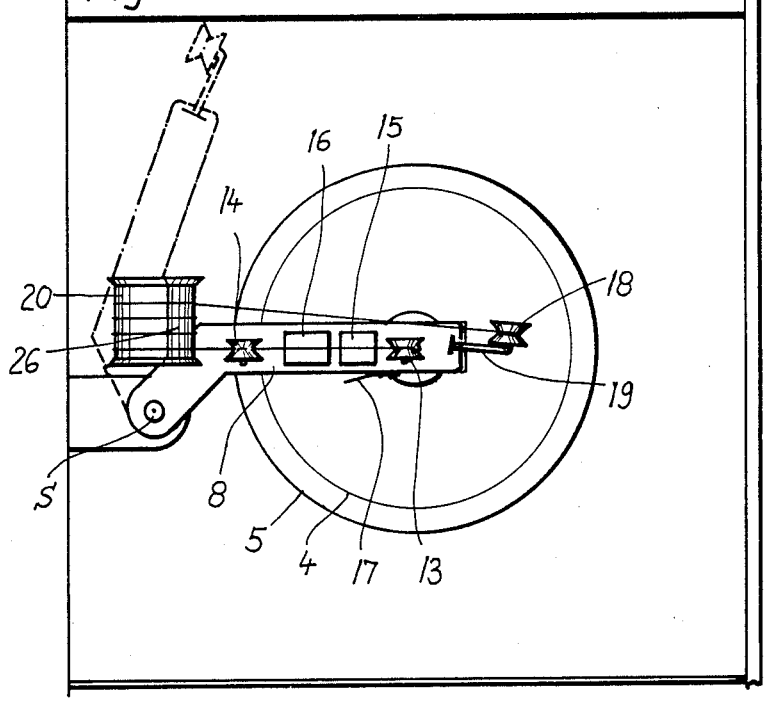

To insert a new feed bobbin 4 in the bobbin container 5, the support arm 8 can, as indicated in dot-dash lines in FIG. 3, be pivoted to the side about the vertical axis S. In spite of the small vertical distance between the spindle or bobbin container 5 and the support arm 8, this produces sufficient space to be able to insert a full feed bobbin 4 from above in the bobbin container 5. On pivoting the support arm 8, the second guide roller 14 which is mounted on it is pivoted too. Here it is essential that the second guide roller 14 is as close as possible to the pivot axis S of the support arm 8, so that the twine being taken up by the galette is displaced as little as possible.

Particular advantages in relation to ease of operation are also achieved by the two thread clamps 17 and 25. When changing of the take-up bobbin 24 becomes necessary, which may be caused by a length measuring device or by the feed bobbin 4 on the spindle running out, both threads F1 and F2 and also the twine Z at first remain fully threaded. The twine is cut off at the take-up bobbin 24, and the end of the twine from the third guide roller 18 is clamped at the second thread clamp 25. Beneath the thread combining means 7, the two threads F1 and F2 are also cut off and clamped at the second thread clamp 17. After new feed bobbins 4 and also 10 have been inserted and the thread F2 has been threaded if necessary by means of compressed air through the tube 11 and the spindle rotor 3*a*, the thread ends of the new threads F1 and F2 are tied together with the thread ends previously clamped at the thread clamp 17. The twine end previously fixed at thread clamp 25 can now be pulled and applied to the new take-up bobbin. In this way, the laborious threading and insertion of the threads in the thread combining means and the subsequent thread guide means and the delivery device is avoided.

If necessary the support arm 8 could also be pivotable about a horizontal axis extending in the longitudinal direction of the machine. The embodiment described first, however, has the advantage that it does not on any account collide with the delivery device 20, 26.

We claim:

1. In a cabling machine, with a machine frame and several cabling stations arranged therein adjacent to each other in a longitudinal direction of the machine in two rows extending symmetrically relative to a vertical longitudinal center plane of the machine, each said cabling station including a cabling spindle rotatable about a spindle axis, a horizontal support arm mounted on said machine frame, a thread combining means disposed on said horizontal support arm above said cabling spindle on said spindle axis, a delivery device disposed above said support arm, a thread monitor provided on said support arm between said thread combining means and said delivery device, and, supported above said delivery device, a take-up device with a thread guide reciprocatable in said longitudinal direction of the machine, the improvement comprising said spindles being arranged adjacent the bottom of said machine frame, each said support arm being pivotable about a pivot axis arranged between the associated said spindle axis and said vertical longitudinal center plane of the machine but being lockable in a working position with the associated said thread combining means disposed above the associated said spindle on the associated said spindle axis, a first guide roller being disposed on each said support arm and on the associated said spindle axis, a second guide roller being provided offset from said first guide roller towards said longitudinal center plane of the machine, said thread monitor and a thread cutter being provided between said first and second guide rollers, a third guide roller being disposed at a free end of said support ram facing towards the outside of the machine, and said delivery device being disposed between a vertical plane extending through said second guide roller parallel to said longitudinal center plane of the machine, and said longitudinal center plane of the machine.

2. The cabling machine according to claim 1, wherein said third guide roller is spring mounted on said support arm to allow movement, against a spring force applied by said spring mounting, in a direction extending between said third guide roller and said take-up device.

3. The cabling machine according to claim 1, wherein said second guide roller is disposed in the vicinity of said pivot axis.

4. The cabling machine according to claim 1, wherein said pivot axis is vertical.

5. The cabling machine according to claim 4, wherein a spring-loaded latching device is provided for fixing said support arm in said working position.

6. The cabling machine according to claim 1, wherein said support arm is pivotable upwards, said pivot axis being horizontal and extending parallel to said longitudinal center plane of the machine.

7. The cabling machine according to claim 1, wherein a first thread clamp is disposed on said support arm.

8. The cabling machine according to claim 7, wherein a second thread clamp is provided in the vicinity of said take-up device.

* * * * *